US012781764B2

(12) United States Patent
Tokieda et al.

(10) Patent No.: US 12,781,764 B2
(45) Date of Patent: Nov. 3, 2026

(54) CENTRIFUGAL COMPRESSOR

(71) Applicant: IHI Corporation, Tokyo (JP)

(72) Inventors: Katsunori Tokieda, Tokyo (JP); Naoto Shimohara, Tokyo (JP)

(73) Assignee: IHI Corporation, Tokyo (JP)

( * ) Notice: Subject to any disclaimer, the term of this patent is extended or adjusted under 35 U.S.C. 154(b) by 0 days.

(21) Appl. No.: 19/335,510

(22) Filed: Sep. 22, 2025

(65) Prior Publication Data

US 2026/0016023 A1 Jan. 15, 2026

Related U.S. Application Data

(63) Continuation of application No. PCT/JP2024/011469, filed on Mar. 22, 2024.

(30) Foreign Application Priority Data

Mar. 24, 2023 (JP) ..... 2023-047895

(51) Int. Cl.
*F04D 29/44* (2006.01)
*F04D 17/10* (2006.01)
*F04D 29/28* (2006.01)

(52) U.S. Cl.
CPC ..... *F04D 29/444* (2013.01); *F04D 17/10* (2013.01); *F04D 29/284* (2013.01)

(58) Field of Classification Search
CPC ..... F04D 29/442; F04D 29/44; F04D 29/444; F04D 29/448; F04D 29/441
See application file for complete search history.

(56) References Cited

U.S. PATENT DOCUMENTS 3,644,055 A * 2/1972 Davis ..... F04D 29/30 415/914
4,626,168 A * 12/1986 Osborne ..... F04D 29/444 415/208.3

(Continued)

FOREIGN PATENT DOCUMENTS

JP 60-135697 A 7/1985
JP 63-12699 U 1/1988

(Continued)

OTHER PUBLICATIONS

International Search Report issued Jun. 4, 2024 in PCT/JP2024/011469 filed Mar. 22, 2024, citing documents 16-19 therein, 2 pages.

*Primary Examiner* — Nathaniel E Wiehe
*Assistant Examiner* — Maxime M Adjagbe
(74) *Attorney, Agent, or Firm* — Oblon, McClelland, Maier & Neustadt, L.L.P.

(57) ABSTRACT

The centrifugal compressor includes a compressor impeller, a diffuser flow path that is located outside the compressor impeller in a radial direction and into which fluid from the compressor impeller flows, a plurality of vanes that is provided in the diffuser flow path and that is arranged along a circumferential direction, a first surface that defines the diffuser flow path, and a second surface that defines the diffuser flow path and that faces the first surface across the plurality of vanes, wherein a clearance is formed between each of the plurality of vanes and at least one of the first surface and the second surface, the clearance extending radially outward from a leading edge of each of the plurality of vanes and being closed or narrowed at a position between the leading edge and a trailing edge.

4 Claims, 9 Drawing Sheets

(56) References Cited

U.S. PATENT DOCUMENTS

| | | | | |
|---|---|---|---|---|
| 5,178,516 | A * | 1/1993 | Nakagawa | F04D 29/444 415/211.2 |
| 5,529,457 | A * | 6/1996 | Terasaki | F04D 29/444 415/208.4 |
| 6,200,094 | B1 * | 3/2001 | Skoch | F04D 29/444 415/208.4 |
| 7,101,151 | B2 * | 9/2006 | Loringer | F04D 29/684 415/211.2 |
| 2018/0073520 | A1 * | 3/2018 | Soeguet | F04D 17/10 |

FOREIGN PATENT DOCUMENTS

| | | | |
|---|---|---|---|
| JP | 6-330896 | A | 11/1994 |
| JP | 7-259796 | A | 10/1995 |
| JP | 10-9196 | A | 1/1998 |
| JP | 2002-357199 | A | 12/2002 |
| JP | 2008-215250 | A | 9/2008 |
| JP | 2010-190149 | A | 9/2010 |
| JP | 2015-108342 | A | 6/2015 |

* cited by examiner

CENTRIFUGAL COMPRESSOR

CROSS REFERENCE TO RELATED APPLICATIONS

This application is a continuation application of International Application No. PCT/JP2024/011469, filed on Mar. 22, 2024, which claims priority to Japanese Patent Application No. 2023-047895 filed on Mar. 24, 2023, the entire contents of which are incorporated herein by reference.

BACKGROUND ART

Technical Field

The present disclosure relates to a centrifugal compressor.

A centrifugal compressor may include a plurality of vanes in a diffuser flow path. For example, Patent Literature 1 discloses a centrifugal compressor including a diffuser with a plurality of partition walls. Each partition wall is divided into a fixed wall on a radially outer side and a thermally actuated wall on a radially inner side. A small gap is formed between the fixed wall and the thermally actuated wall. The fixed wall is fixed to a diffuser surface at both ends. A radially outer half of the thermally actuated wall is fixed to the diffuser surface at both ends, while a radially inner half has a clearance between the ends and the diffuser surface. Accordingly, the radially inner half of the thermally actuated walls is deformable. The thermally actuated wall includes two metal plates. A plate with a low thermal expansion coefficient is arranged on a back side, and a plate with a high thermal expansion coefficient is arranged on a front side. According to such a configuration, the thermally actuated wall is configured such that a throat width between two thermally actuated walls is widen when gas flowing into the diffuser is at a low temperature (low-speed rotation state), and is narrowed when the gas is at a high temperature (high-speed rotation state), due to a difference in thermal expansion coefficients of the two metal plates. As such, the amount of gas flowing into the diffuser can be controlled according to the rotation state of the centrifugal compressor.

CITATION LIST

Patent Literature

Patent Literature 1: JP H10-9196 A

SUMMARY

Technical Problem

When a centrifugal compressor includes a plurality of vanes in a diffuser flow path, a phenomenon called "rotor-stator interaction" may occur. In a centrifugal compressor, it is desirable to reduce exciting force caused by this phenomenon.

The present disclosure aims to provide a centrifugal compressor that can reduce exciting force.

Solution to Problem

In order to solve the above problem, a centrifugal compressor according to one aspect of the present disclosure includes a compressor impeller, a diffuser flow path that is located outside the compressor impeller in a radial direction and into which fluid from the compressor impeller flows, a plurality of vanes that is provided in the diffuser flow path and that is arranged along a circumferential direction, a first surface that defines the diffuser flow path, a second surface that defines the diffuser flow path and that faces the first surface across the vanes, wherein a clearance is formed between each of the plurality of vanes and at least one of the first surface and the second surface, the clearance extending radially outward from a leading edge of the vane and being closed or narrowed at a position between the leading edge and a trailing edge.

The clearance may be formed between each vane and one of the first surface and the second surface, and the leading edge may be in contact with the other of the first surface and the second surface.

The centrifugal compressor may include a shroud that faces blade surfaces of the compressor impeller and that is continuous with the first surface, and the clearance may be formed between each vane and the first surface, and the leading edge may be in contact with the second surface.

The clearance may continuously decrease as moving radially outward from the leading edge to the position between the leading edge and the trailing edge.

A height of the vane in an axial direction may be lower at the clearance than at other positions.

The at least one of the first surface and the second surface may include an area that defines the clearance and that intersects the radial direction.

In a configuration where the at least one of the first surface and the second surface includes the area that defines the clearance and that intersects the radial direction, both end faces of the vane in the axial direction may be parallel to the radial direction, and the vane may be rotatable around a central axis that is parallel to an axial direction.

In a configuration where the vane is rotatable, the clearance may disappear in a position where a throat width between two adjacent vanes among a plurality of vanes is narrowest.

Effects

According to the present disclosure, exciting force can be reduced.

DESCRIPTION OF EMBODIMENTS

Embodiments of the present disclosure will be described in detail below with reference to the accompanying drawings. Specific dimensions, materials, and numerical values described in the embodiments are merely examples for a better understanding, and do not limit the present disclosure unless otherwise specified. In this specification and the drawings, duplicate explanations are omitted for elements having substantially the same functions and configurations by assigning the same sign. Furthermore, elements not directly related to the present disclosure are omitted from the figures.

Figure 1:
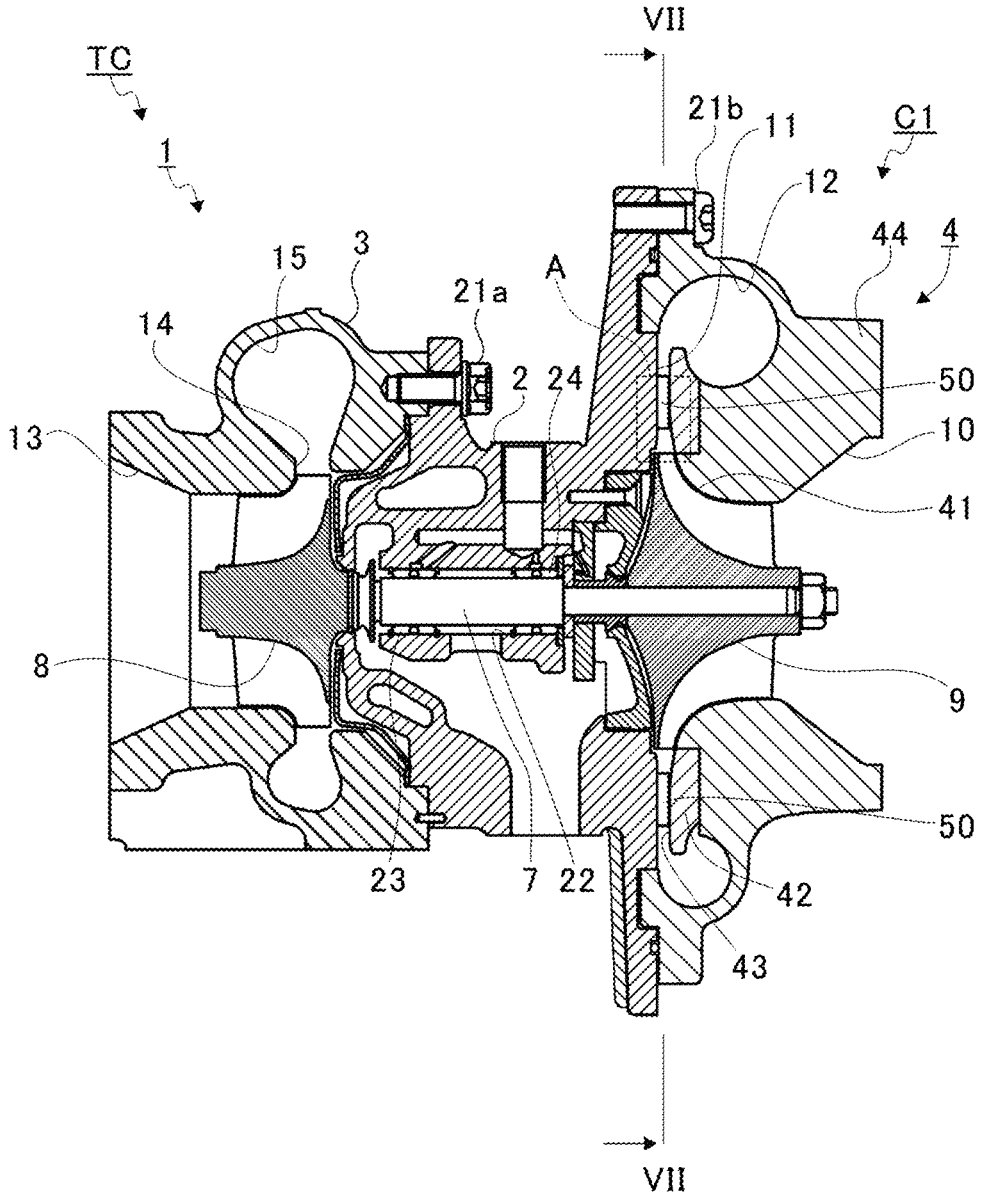
FIG. 1 is a schematic cross-sectional view of a turbocharger including a centrifugal compressor according to a first embodiment.

FIG. 1 is a schematic cross-sectional view of a turbocharger TC including a centrifugal compressor C1 according to a first embodiment. For example, the turbocharger TC is applied to an engine. The turbocharger TC includes a housing 1, a shaft 7, a turbine impeller 8, and a compressor impeller 9.

As will be described later, the turbine impeller 8 and the compressor impeller 9 are concentrically arranged with the shaft 7 and rotate integrally with the shaft 7. Accordingly, in the present disclosure, axial directions, radial directions, and circumferential directions of the shaft 7, the turbine impeller 8, and the compressor impeller 9 may simply be referred to as an "axial direction," a "radial direction," and a "circumferential direction," respectively, unless otherwise specified. Furthermore, in the present disclosure, center axes of the shaft 7, the turbine impeller 8, and the compressor impeller 9 may simply be referred to as a "central axis," unless otherwise specified.

The housing 1 includes a bearing housing 2, a turbine housing 3, and a compressor housing 4. In the axial direction, one end of the bearing housing 2 is connected to the turbine housing 3 by a fastener 21*a* such as a bolt. In the axial direction, the other end of the bearing housing 2 is connected to the compressor housing 4 by a fastener 21*b* such as a bolt.

The bearing housing 2 includes a bearing hole 22. The bearing hole 22 extends in the axial direction within the bearing housing 2. The bearing hole 22 accommodates bearings 23 and 24. The bearings 23 and 24 rotatably support the shaft 7.

The turbine impeller 8 is provided at a first end of the shaft 7 in the axial direction. The turbine impeller 8 is rotatably accommodated in the turbine housing 3. The compressor impeller 9 is provided at a second end that is opposite to the first end of the shaft 7 in the axial direction. The compressor impeller 9 is rotatably accommodated in the compressor housing 4. The shaft 7, the turbine impeller 8, and the compressor impeller 9 rotate integrally with each other.

The compressor housing 4 includes an intake opening 10 at an end that is opposite to the bearing housing 2 in the axial direction. The intake opening 10 is connected to an air cleaner (not shown). The bearing housing 2 and the compressor housing 4 define a diffuser flow path 11 therebetween. The diffuser flow path 11 has an annular shape. The diffuser flow path 11 is located outside the compressor impeller 9 in the radial direction. The diffuser flow path 11 is connected to the intake opening 10 via the compressor impeller 9. The diffuser flow path 11 accommodates a plurality of vanes 50 (described in detail below).

The compressor housing 4 includes a compressor scroll flow path 12. The compressor scroll flow path 12 is located outside the diffuser flow path 11 in the radial direction. The compressor scroll flow path 12 is connected to the diffuser flow path 11. Furthermore, the compressor scroll flow path 12 is connected to an intake port of an engine (not shown).

The compressor housing 4 includes a shroud 41. The shroud 41 is located outside the compressor impeller 9 in the radial direction, and faces blade surfaces of the compressor impeller 9 in the radial direction and in the axial direction. A gap is formed between the shroud 41 and blades of the compressor impeller 9. The shroud 41 has a curved-surface shape that expands radially outward as moving away from the intake opening 10 in the axial direction.

In the present embodiment, a part of the compressor housing 4 is formed as an annular piece 42. For example, the annular piece 42 includes at least a surface that faces the vanes 50 in the axial direction in the compressor housing 4. Specifically, the annular piece 42 includes a first surface 43. The first surface 43 defines the diffuser flow path 11. The first surface 43 is continuous with the shroud 41. In the present embodiment, the remaining part of the compressor housing 4 is formed as a main body 44. The annular piece 42 is fixed to the main body 44. In the present embodiment, the annular piece 42 is fitted into the main body 44. In another embodiment, the annular piece 42 may be fixed to the main body 44 by other means, such as a bolt.

In the centrifugal compressor C1, as the compressor impeller 9 rotates, fluid (e.g., air) is sucked into the compressor housing 4 from the intake opening 10. The fluid is accelerated while passing through the compressor impeller 9. The fluid is pressurized in the diffuser flow path 11 and the compressor scroll flow path 12. The pressurized fluid flows out from an outlet (not shown) and is led to the intake port of the engine.

The turbine housing 3 includes an exhaust opening 13 at an end that is opposite to the bearing housing 2 in the axial direction. The exhaust opening 13 is connected to an exhaust gas purifier (not shown). The turbine housing 3 includes a flow path 14. The flow path 14 has an annular shape. The flow path 14 is located outside the turbine impeller 8 in the radial direction. The flow path 14 is connected to the exhaust opening 13 via the turbine impeller 8.

The turbine housing 3 includes a turbine scroll flow path 15. The turbine scroll flow path 15 is located outside the flow path 14 in the radial direction. The turbine scroll flow path 15 is connected to the flow path 14. Furthermore, the turbine scroll flow path 15 is connected to a gas inlet (not shown). The gas inlet receives exhaust gas discharged from an exhaust manifold (not shown) of the engine.

In the turbine housing 3, the exhaust gas is led from the gas inlet to the turbine scroll flow path 15, and further led to the exhaust opening 13 via the flow path 14 and the turbine impeller 8. The exhaust gas rotates the turbine impeller 8 while passing through the turbine impeller 8.

The rotational force of the turbine impeller 8 is transmitted to the compressor impeller 9 via the shaft 7. When the compressor impeller 9 rotates, the fluid is pressurized as described above. As such, the pressurized fluid is led to the intake port of the engine.

Next, the diffuser flow path 11 and the vanes 50 will be described in detail.

Figure 2:
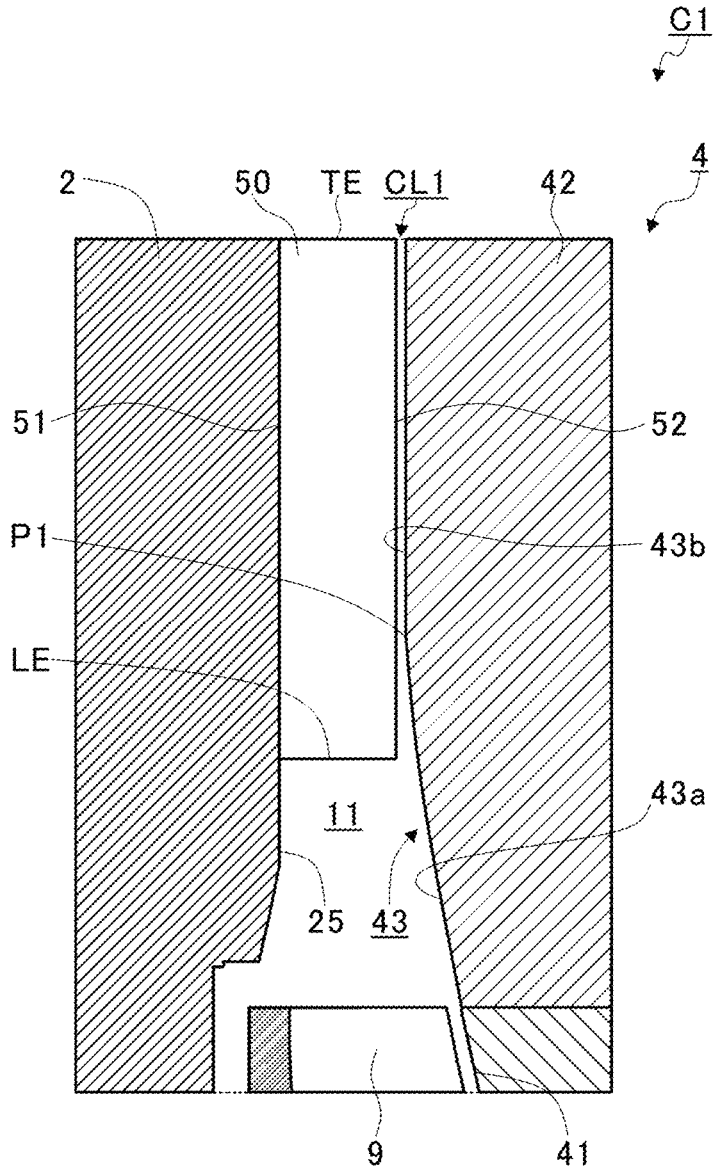
FIG. 2 is a schematic enlarged cross-sectional view of part A in FIG. 1.

FIG. 2 is a schematic enlarged cross-sectional view of part A in FIG. 1. In FIG. 2, only one vane 50 is shown, but other vanes 50 are similarly configured. As described above, the annular piece 42 of the compressor housing 4 includes the first surface 43. The bearing housing 2 includes a second surface 25 that faces the first surface 43 in the axial direction. The diffuser flow path 11 is defined by the first surface 43 and the second surface 25. In the present disclosure, "define" may refer to determining a partition or a boundary of a space such as a flow path or a clearance. In the present embodiment, the second surface 25 has a flat shape that is parallel to the radial direction and that extends from an inner side to an outer side with respect to a leading edge LE of the vane 50 in the radial direction.

The vane 50 is arranged outside the compressor impeller 9 in the radial direction. The plurality of vanes 50 is arranged along the circumferential direction. In the present embodiment, end faces 51 and 52 of the vane 50 in the axial direction are parallel to the radial direction. In the present embodiment, the end face 51 of the vane 50 is fixed to the second surface 25. Accordingly, the leading edge LE of the vane 50 is in contact with the second surface 25. The whole of each vane 50 is formed from the same material, such as an aluminum alloy or other metal. Each vane 50 is formed monolithically from the leading edge LE to a trailing edge TE.

In the present embodiment, an axial clearance CL1 is formed between the end face 52 of each vane 50 and the first surface 43. The clearance CL1 extends radially outward from the leading edge LE of each vane 50, and is narrowed between the leading edge LE and the trailing edge TE. Specifically, the clearance CL1 extends from the leading edge LE to the trailing edge TE, while continuously decreasing as moving radially outward from the leading edge LE to a position P1 between the leading edge LE and the trailing edge TE.

More specifically, in the present embodiment, the first surface 43 includes, in an area that is radially inside the position P1, a curved surface 43*a* that is continuous with the shroud 41 and that is inclined with respect to the radial direction, and includes, in an area that is radially outside the position P1, a flat surface 43*b* that is parallel to the radial direction. In other words, the position P1 can also be referred to as a boundary between the radially-inner curved surface 43*a* and the radially-outer flat surface 43*b* in the first surface 43. The clearance CL1 continuously decreases as moving radially outward in an area where the end face 52 of the vane 50 faces the curved surface 43*a*, and is constant in an area where the end face 52 faces the flat surface 43*b*.

For example, dimensions such as a width of clearance CL1 in the axial direction and a distance from the leading edge LE to the position P1 in the radial direction may be determined in consideration of factors such as exciting force of the centrifugal compressor C1 and efficiency of the centrifugal compressor C1.

Figure 3:
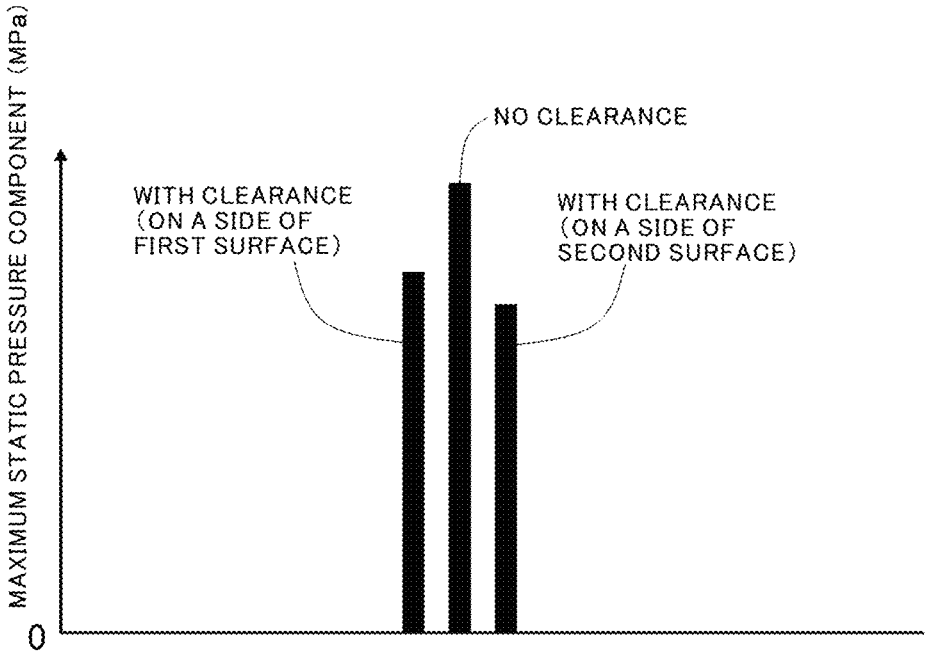
FIG. 3 shows results of analyses of exciting force.

FIG. 3 shows results of analyses of exciting force. Fluid analyses (CFD: Computational Fluid Dynamics) were performed with using models that are similar to the centrifugal compressor C1 as shown in FIGS. 1 and 2. Three models were used in the analyses. The first model does not include a clearance between each vane 50 and the first surface 43 and between each vane 50 and the second surface 25 (no clearance). The second model includes a clearance between each vane 50 and the first surface 43 (with clearance (on a side of the first surface)). The third model includes a clearance between each vane 50 and the second surface 25 (with clearance (on a side of the second surface)). Note that in these analyses, the clearances in the second model and the third model extend from the leading edge LE to the trailing edge TE with a constant width.

A vertical axis indicates a maximum static pressure component around the vane 50, corresponding to the exciting force. It is known that a vaned diffuser exhibits larger exciting force due to a phenomenon called "rotor-stator interaction" in a vibration mode having a mode order that is equal to the number of vanes 50. Accordingly, FIG. 3 shows results of analyses in a vibration mode having a mode order that is equal to the number of vanes 50.

As can be understood from FIG. 3, the exciting force is reduced by forming a clearance on the side of first surface or on the side of the second surface. However, such a clearance also reduces efficiency of the centrifugal compressor C1. In the present embodiment, the exciting force can be reduced by forming the clearance CL1 between the vanes 50 and the first surface 43, and reduction in efficiency can be curbed by narrowing the width of the clearance CL1 at the position P1 between the leading edge LE and the trailing edge TE.

The centrifugal compressor C1 as described above includes the compressor impeller 9, the diffuser flow path 11 that is located outside the compressor impeller 9 in the radial direction and into which the fluid from the compressor impeller 9 flows, the plurality of vanes 50 that is provided in the diffuser flow path 11 and that is arranged along the circumferential direction, the first surface 43 that defines the diffuser flow path 11, and the second surface 44 that defines the diffuser flow path 11 and that faces the first surface 43 across the vanes 50. The clearance C1 that extends radially outward from the leading edge LE of the vane 50 and that is narrowed at the position P1 between the leading edge LE and the trailing edge TE is formed between each vane 50 and the first surface 43. According to such a configuration, the exciting force can be reduced by forming the clearance CL1 between the vane 50 and the first surface 43, and reduction in efficiency can be curbed by narrowing the width of the clearance CL1 at the position P1.

Furthermore, in the centrifugal compressor C1, the clearance CL1 is formed between each vane 50 and one of the first surface 43 and the second surface 25 (between each vane 50 and the first surface 43 in the present embodiment), and the leading edge LE is in contact with the other of the first surface 43 and the second surface 25 (the second surface 25 in the present embodiment). According to such a configuration, one end of the leading edge LE contacts either the first surface 43 or the second surface 25. Accordingly, increase in exciting force can be curbed by the contact.

Furthermore, the centrifugal compressor C1 includes the shroud 41 that faces the blade surfaces of the compressor impeller 9 and that is continuous with the first surface 43, wherein the clearance CL1 is formed between each vane 50 and the first surface 43, and the leading edge LE is in contact with the second surface 25. According to such a configuration, the clearance CL1 is defined by the first surface 43 that is continuous with the shroud 41, and therefore the clearance CL1 can be formed as an extension of the shroud 41. As such, for example, the clearance CL1 can be formed by redesigning existing centrifugal compressor C1.

Furthermore, in the centrifugal compressor C1, the clearance CL1 continuously decreases as moving radially outward from the leading edge LE to the position P1 between the leading edge LE and the trailing edge TE. According to such a configuration, sudden change in flow can be avoided.

Furthermore, in the centrifugal compressor C1, the at least one of the first surface 43 and the second surface 25 (the first surface 43 in the present embodiment) includes the curved surface 43*a* that defines the clearance CL1 and that intersects the radial direction. According to such a configuration, sudden change in flow can be avoided.

Next, other embodiments will be described.

Figure 4:
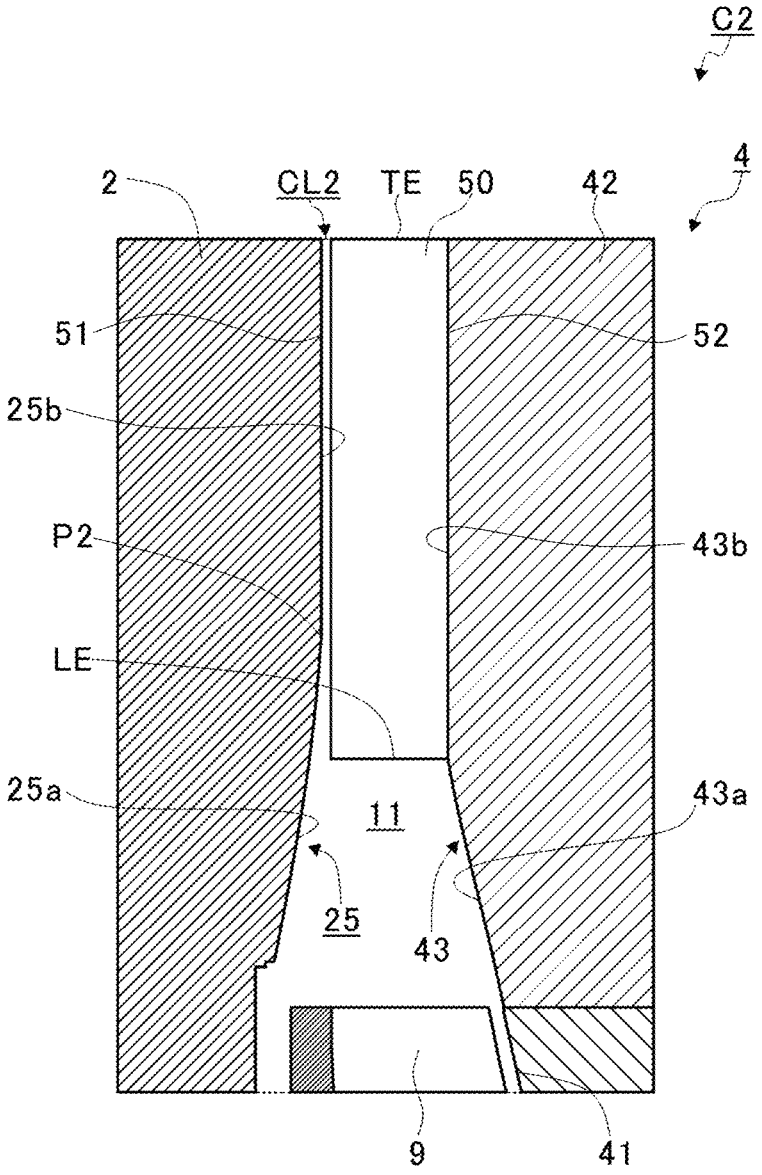
FIG. 4 is a schematic enlarged cross-sectional view of a centrifugal compressor according to a second embodiment.

FIG. 4 is a schematic enlarged cross-sectional view of a centrifugal compressor C2 according to a second embodiment. The centrifugal compressor C2 differs from the centrifugal compressor C1 according to the first embodiment in that a clearance CL2 is formed between each vane 50 and the second surface 25. For other configurations, the centrifugal compressor C2 may be the same as the centrifugal compressor C1.

In the present embodiment, the first surface 43 includes the curved surface 43*a* in an area that is radially inside the leading edge LE, and includes the flat surface 43*b* in an area that is radially outside the leading edge LE, instead of the position P1 (not shown in FIG. 4). In the present embodiment, the end face 52 of the vane 50 is fixed to the flat surface 43*b* of the first surface 43. Accordingly, the leading edge LE of the vane 50 is in contact with the first surface 43.

In the present embodiment, the second surface 25 includes, in an area that is radially inside a position P2 between the leading edge LE and the trailing edge TE, a curved surface 25*a* that is inclined with respect to the radial direction so as to approach the vane 50 as approaching the position P2, and includes, in an area that is radially outside the position P2, a flat surface 25*b* that is parallel to the radial direction. In other words, the position P2 can also be referred to as a boundary between the radially-inner curved surface 25*a* and the radially-outer flat surface 25*b* in the second surface 25.

In the present embodiment, an axial clearance CL2 is formed between each vane 50 and the second surface 25. In the present embodiment, the clearance CL2 extends from the leading edge LE to the trailing edge TE, while continuously decreasing as moving radially outward from the leading edge LE to the position P2. More specifically, the clearance CL2 continuously decreases as moving radially outward in an area where the end face 51 of the vane 50 faces the curved surface 25*a*, and is constant in an area where the end face 51 faces the flat surface 25*b*.

Such a centrifugal compressor C2 may have substantially similar effects to those of the centrifugal compressor C1.

Figure 5:
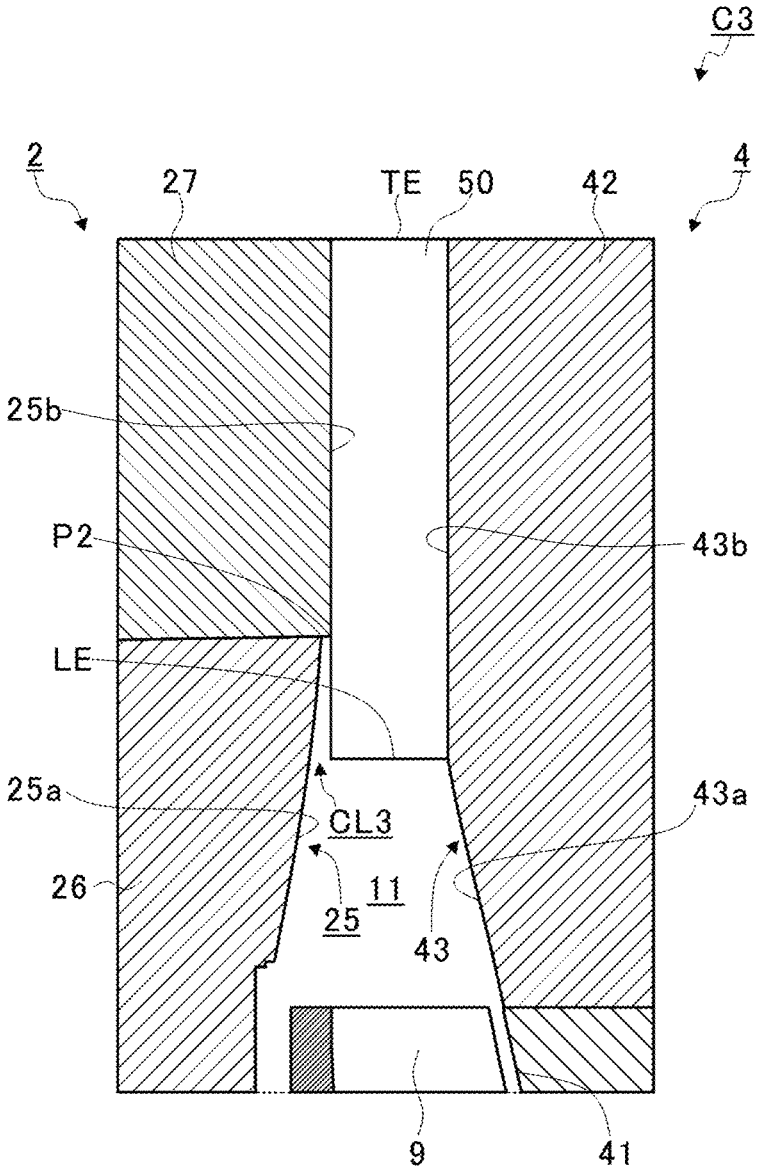
FIG. 5 is a schematic enlarged cross-sectional view of a centrifugal compressor according to a third embodiment.

FIG. 5 is a schematic enlarged cross-sectional view of a centrifugal compressor C3 according to a third embodiment. The centrifugal compressor C3 differs from the centrifugal compressor C2 according to the second embodiment in that the vanes 50 are also fixed to the second surface 25. For other configurations, the centrifugal compressor C3 may be the same as the centrifugal compressor C2.

In the present embodiment, a part of the bearing housing 2 is formed as an annular piece 26. For example, the annular piece 26 may include at least the curved surface 25*a*. In the present embodiment, the remaining part of the bearing housing 2 is formed as a main body 27. The annular piece 26 is fixed to the main body 27. In the present embodiment, the annular piece 26 is fitted into the main body 27. In another embodiment, the annular piece 26 may be fixed to the main body 27 by other means, such as a bolt.

In the present embodiment, the vanes 50 are fixed to the second surface 25, more specifically to the flat surface 25*b*, in an area that is radially outside the position P2. Accordingly, in the present embodiment, the vanes 50 are fixed on both sides of the axial direction.

In the present embodiment, the clearance CL3 extends radially outward from the leading edge LE, and is closed at the position P2 between the leading edge LE and the trailing edge TE.

Such a centrifugal compressor C3 may have substantially similar effects to those of the centrifugal compressors C1 and C2. In particular, in the present embodiment, the clearance CL3 is closed at the position P2 between the leading edge LE and the trailing edge TE. As such, the exciting force can be reduced while further curbing decrease in efficiency.

Figure 6:
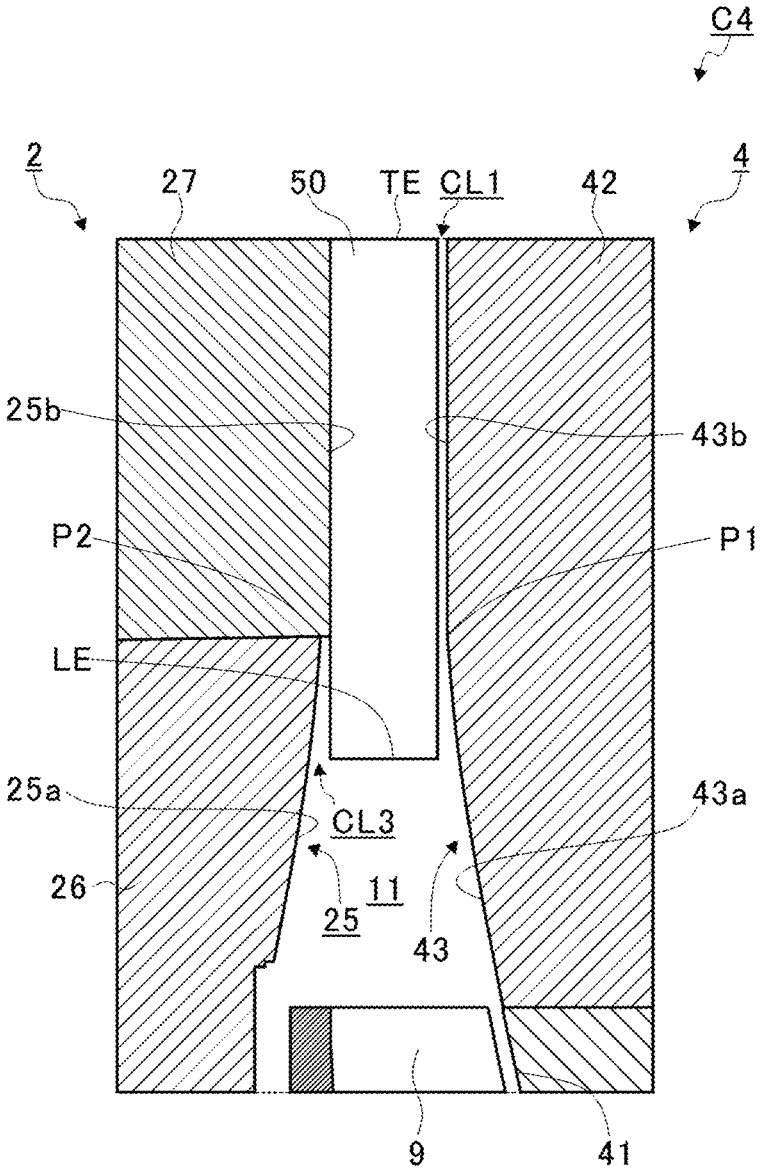
FIG. 6 is a schematic enlarged cross-sectional view of a centrifugal compressor according to a fourth embodiment.

FIG. 6 is a schematic enlarged cross-sectional view of a centrifugal compressor C4 according to a fourth embodiment. The centrifugal compressor C4 differs from the centrifugal compressor C3 according to the third embodiment in that the clearance CL1 is also formed between each vane 50 and the first surface 43. For other configurations, the centrifugal compressor C4 may be the same as the centrifugal compressor C3.

The first surface 43 and the clearance CL1 between each vane 50 and the first surface 43 may be configured in the same manner as in the first embodiment. Accordingly, the centrifugal compressor C4 can be said to be a combination of the centrifugal compressor C1 according to the first embodiment and the centrifugal compressor C3 according to the third embodiment.

Such a centrifugal compressor C4 may have substantially similar effects to those of the centrifugal compressors C1, C2, and C3. In particular, in the present embodiment, the centrifugal compressor C4 includes the clearance CL1 between each vane 50 and the first surface 43, and the clearance CL3 between each vane 50 and the second surface 25. As such, the exciting force may further be reduced.

Figure 7A:
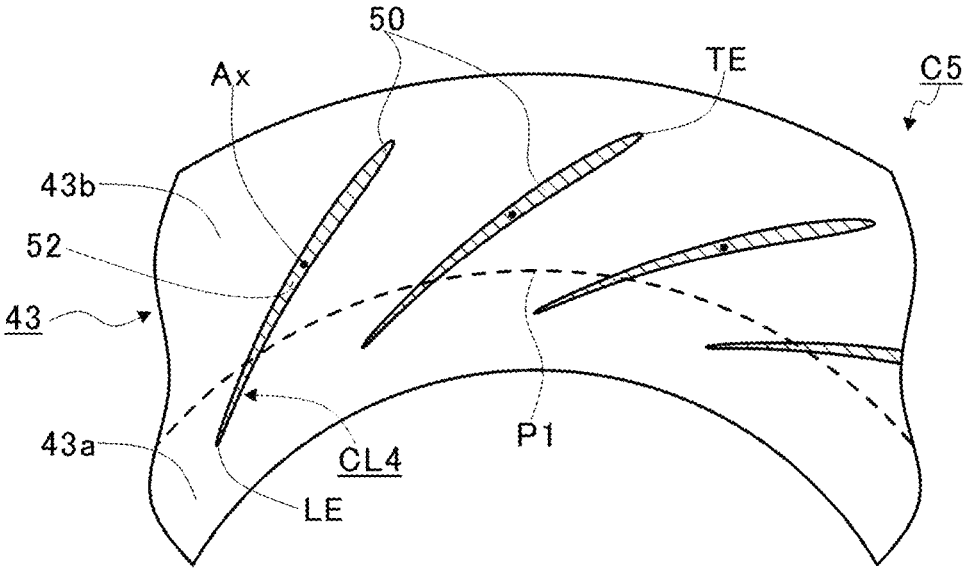
FIG. 7A is a schematic cross-sectional view of a centrifugal compressor in a first position according to a fifth embodiment.
Figure 7B:
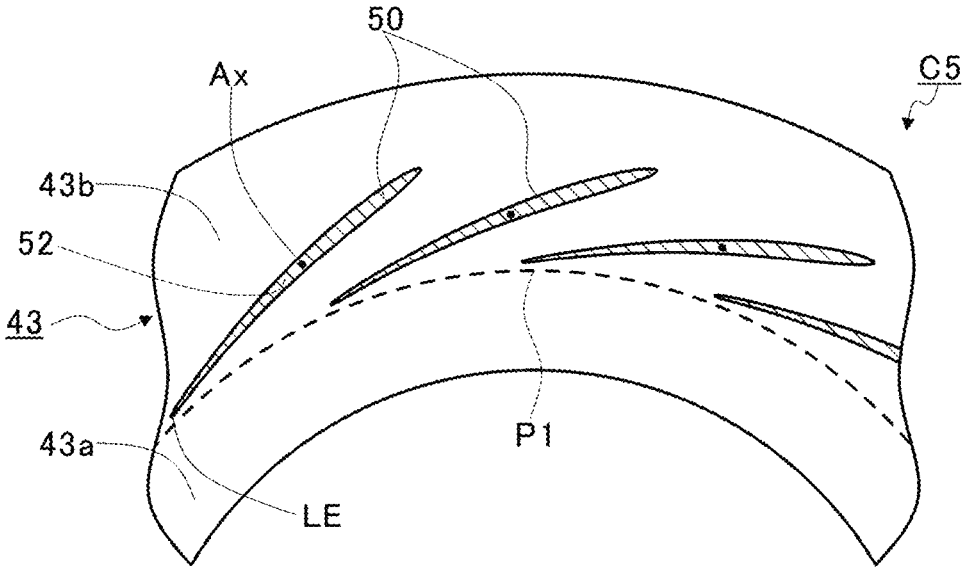
FIG. 7B is a schematic cross-sectional view of the centrifugal compressor in a second position according to the fifth embodiment.

FIGS. 7A and 7B are schematic cross-sectional views of a centrifugal compressor C5 according to a fifth embodiment. FIGS. 7A and 7B correspond to a part of the cross-sectional view obtained along line VII-VII in FIG. 1, and shows a part of the plurality of vanes 50 as seen in the axial direction. The centrifugal compressor C5 differs from the centrifugal compressor C1 according to the first embodiment in that each vane 50 is rotatable around a central axis Ax that is parallel to the axial direction. For other configurations, the centrifugal compressor C5 may be the same as the centrifugal compressor C1.

FIG. 7A shows the vanes 50 in a first position where a throat width between adjacent vanes 50 is widest. FIG. 7B shows the vanes 50 in a second position where the throat width is narrowest. As described above, in the present embodiment, each vane 50 is rotatable around the central axis Ax. Accordingly, in the present embodiment, the "position P1 between the leading edge LE and the trailing edge TE" may be defined as a position between the leading edge LE and the trailing edge TE in the vane 50 in the first position. Furthermore, as described above, the position P1 is also defined as the boundary between the radially-inner curved surface 43*a* and the radially-outer flat surface 43*b* in the first surface 43. In FIGS. 7A and 7B, the position P1 is indicated by a dashed line.

As shown in FIG. 7A, when the vanes 50 are arranged in the first position, the leading edge LE is located radially inside the position P1. Accordingly, a part of the end face 52 of the vane 50 faces the curved surface 43*a*. In the present embodiment, as described above, the end face 52 of the vane 50 in the axial direction is parallel to the radial direction. As such, a clearance CL4 is formed between the end face 52 of the vane 50 and the curved surface 43*a*, as in the centrifugal compressor C1 of the first embodiment.

As the vane 50 rotates from the first position to the second position, the area facing the curved surface 43*a* decreases in the end face 52 of the vane 50. Accordingly, the clearance CL4 decreases.

As shown in FIG. 7B, when the vane 50 is arranged in the second position, the leading edge LE is located radially outside the position P1. Accordingly, the end face 52 of the vane 50 does not face the curved surface 43*a* but faces the flat surface 43*b*. Since the vane 50 and the flat surface 43*b* are parallel to each other, the clearance CL4 that is closed or narrowed between the leading edge LE and the trailing edge TE is no longer formed between the vane 50 and the flat surface 43*b*. Note that a slight, constant clearance may be formed along the radial direction between the vane 50 and the flat surface 43*b* to allow rotation of the vane 50.

Such a centrifugal compressor C5 may have substantially similar effects to those of the centrifugal compressor C1. In particular, in the present embodiment, the two end faces 51 and 52 of the vane 50 in the axial direction are parallel to the radial direction, and the vane 50 is rotatable around the central axis Ax that is parallel to the axial direction. According to such a configuration, as the vane 50 rotates from the first position to the second position, the clearance CL4 decreases. For example, when the centrifugal compressor C5 operates at a low rotational speed, the exciting force is not a problem. Accordingly, no clearance is required between the vane 50 and the flat surface 43*b* for operation at a low rotational speed. As such, when the centrifugal compressor C5 operates at a low rotational speed, reduction in efficiency can be curbed by reducing the clearance CL4.

Furthermore, in the centrifugal compressor C5, the clearance CL4 disappears in the second position where the throat width is narrowest. According to such a configuration, reduction in efficiency can further be curbed.

Figure 8:
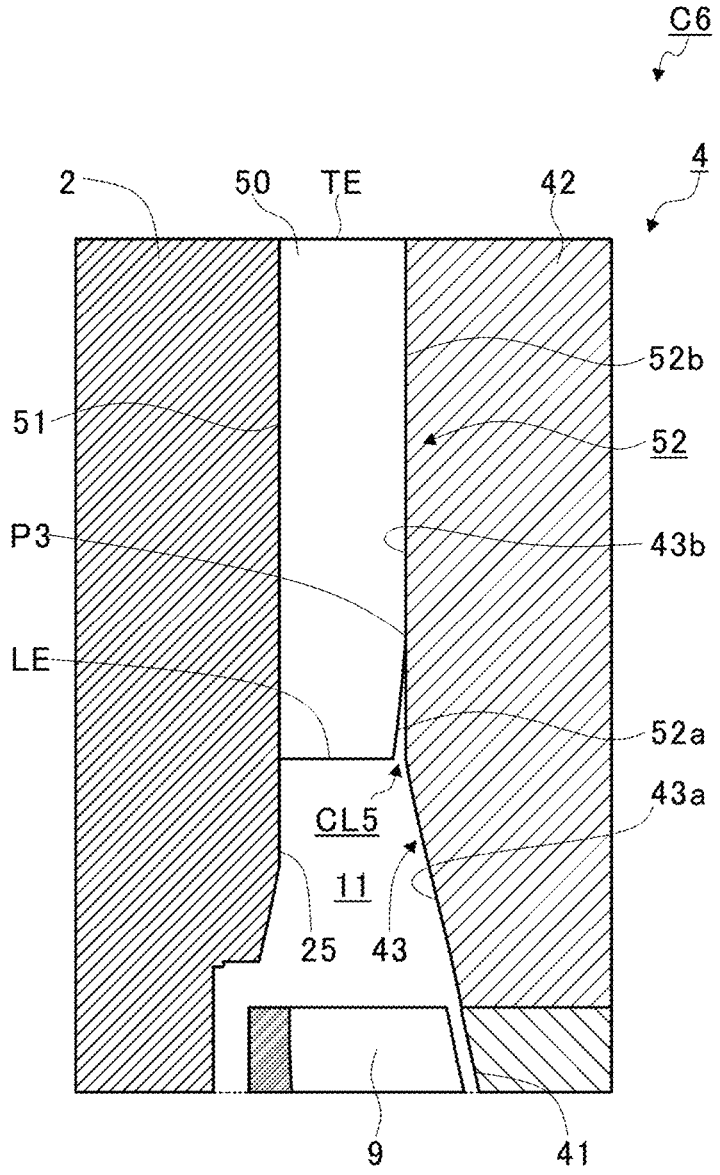
FIG. 8 is a schematic enlarged cross-sectional view of a centrifugal compressor according to a sixth embodiment.

FIG. 8 is a schematic enlarged cross-sectional view of a centrifugal compressor C6 according to a sixth embodiment. The centrifugal compressor C6 differs from the centrifugal compressor C1 according to the first embodiment in that the end face 52 of each vane 50 includes a curved surface 52*a* that is inclined with respect to the radial direction, and a part facing the vanes 50 in the first surface 43 is a flat surface. For other configurations, the centrifugal compressor C6 may be the same as the centrifugal compressor C1.

In the present embodiment, the first surface 43 includes the curved surface 43*a* in an area that is radially inside the leading edge LE, and includes the flat surface 43*b* in an area that is radially outside the leading edge LE, instead of the above-mentioned position P1 (not shown in FIG. 8). In the present embodiment, the vane 50 is fixed to both the flat surface 43*b* of the first surface 43 and the second surface 25.

The end face 52 of the vane 50 includes the curved surface 52*a* that is radially inside the position P3 between the leading edge LE and the trailing edge TE, and a flat surface 52*b* that is radially outside the position P3. The curved surface 52*a* extends outward in the radial direction from the leading edge LE to the position P3 with being inclined with respect to the radial direction. In other words, a height in the axial direction from the end face 51 to the end face 52 of the blade 50 changes from the leading edge LE to the position P3. Specifically, the height in the axial direction of the blade 50 increases as moving from the leading edge LE toward the position P3. The flat surface 52*b* extends parallel with respect to the radial direction from the position P3 to the trailing edge TE. An axial clearance CL5 is formed between the curved surface 52*a* of the vane 50 and the flat surface 43*b* of the first surface 43. In other words, the height in the axial direction of the vane 50 is lower at the axial clearance CL5 than at other positions.

Such a centrifugal compressor C6 may have substantially similar effects to those of the centrifugal compressor C1. In particular, in the present embodiment, the height in the axial direction of the vane 50 is lower at the clearance CL5 than at other positions. According to such a configuration, sudden change in flow can be avoided.

Although the embodiments of the present disclosure have been described above with reference to the accompanying drawings, the present disclosure is not limited thereto. It is obvious that a person skilled in the art can conceive of various examples of variations or modifications within the scope of the claims, which are also understood to belong to the technical scope of the present disclosure.

For example, referring to FIG. 2, in the centrifugal compressor C1 of the first embodiment, the clearance CL1 continuously decreases as moving radially outward from the leading edge LE to the position P1. In another embodiment, for example, the clearance CL1 may be constant from the leading edge LE to the position P1, and may be narrowed at the position P1 in a step manner. In other words, the clearance CL1 may have a rectangular shape from the leading edge LE to the position P1 when seen in a cross-section along the axial direction. The same applies to the other clearances CL2, CL3, and CL5.

Furthermore, referring to FIG. 7B, in the centrifugal compressor C5, the leading edge LE of the vane 50 is located radially outside the position P1 in the second position where the throat width is narrowest. In another embodiment, the leading edge LE may be located radially inside the position P1, in the second position where the throat width is narrowest. In other words, the clearance CL4 need not disappear in the second position.

Furthermore, referring to FIG. 8, in the centrifugal compressor C6, the end face 52 facing the first surface 43 in the vane 50 includes the curved surface 52*a* that defines the clearance CL5. Alternatively or additionally, in another embodiment, the end face 51 facing the second surface 25 may include a similar area.

What is claimed is:

1. A centrifugal compressor comprising:

a compressor impeller;

a diffuser flow path that is located outside the compressor impeller in a radial direction and into which fluid from the compressor impeller flows;

a plurality of vanes that is provided in the diffuser flow path and that is arranged along a circumferential direction;

a shroud that faces blade surfaces of the compressor impeller;

a first surface that is continuous with the shroud and that defines the diffuser flow path; and a second surface that defines the diffuser flow path and that faces the first surface across the plurality of vanes, wherein a clearance is formed between each of the plurality of vanes and the first surface, the clearance extending radially outward from a leading edge of each of the plurality of vanes and being closed or narrowed at a position between the leading edge and a trailing edge, the leading edge is in contact with the second surface, the first surface includes an area that defines the clearance and that intersects the radial direction, both end faces of each of the plurality of vanes in an axial direction are parallel to the radial direction, and each of the plurality of vanes is rotatable around a central axis that is parallel to the axial direction.

2. The centrifugal compressor according to claim 1, wherein the clearance continuously decreases as moving radially outward from the leading edge to the position between the leading edge and the trailing edge.

3. The centrifugal compressor according to claim 1, wherein the clearance disappears in a position where a throat width between two adjacent vanes among the plurality of vanes is narrowest.

4. The centrifugal compressor according to claim 1, wherein the first surface includes a curved surface that is continuous with the shroud and that is inclined with respect to the radial direction, and a flat surface that is parallel to the radial direction.

* * * * *